United States Patent [19]

Granryd

[11] 4,168,008

[45] Sep. 18, 1979

[54] TELESCOPIC CRANE BOOM HAVING CORRUGATED BOOM SECTIONS

[76] Inventor: Tod G. Granryd, 825 N. Sheridan Rd., Lake Forest, Ill. 60045

[21] Appl. No.: 880,637

[22] Filed: Feb. 23, 1978 (Under 37 CFR 1.47)

[51] Int. Cl.[2] ..... B66C 23/68

[52] U.S. Cl. ..... 212/144; 52/118; 52/632; 212/55

[58] Field of Search ..... 212/55, 144; 308/3 R; 52/115, 118, 731, 738, 632

[56] References Cited

U.S. PATENT DOCUMENTS

| | | | |
|---|---|---|---|
| 3,708,937 | 1/1973 | Sterner | 212/55 X |
| 3,931,698 | 1/1976 | Ebersold | 212/55 X |
| 4,069,638 | 1/1978 | Hasselgvist et al. | 52/731 X |

*Primary Examiner*—Robert G. Sheridan
*Attorney, Agent, or Firm*—James E. Nilles

[57] ABSTRACT

A large light-weight telescopic crane boom comprises a plurality of relatively movable boom sections, such as base, intermediate, outer, and fly sections, and each section comprises top and bottom walls and a pair of spaced apart side walls. In each pair of relatively movable adjacent boom sections wherein one (inner) section is telescopically receivable within another (outer) section, the inner surface of the side walls of the outer section and the outer surface of the side walls of the inner section comprise longitudinally extending corrugations or projections which interengage and whereby the inner section is slideably supported on the outer section. The corrugations or projections on each wall surface are arranged in two (upper and lower) sets, one above and the other below, the longitudinal neutral axis of the crane boom. When the inner section is telescoped within the outer section and the crane boom is not loaded, the upper set of corrugations of the inner section rest in slideable engagement on the upper set of corrugations of the outer section. When the inner section is extended relative to the outer section and the crane boom is loaded, the inner section flexes downward sufficiently so that the lower set of corrugations of the inner section also rest on the lower set of corrugations of the outer section to thereby distribute the load and increase the area of slideable engagement between the two boom sections. Mating surfaces of projections which are subject to sliding engagement are coated with anti-friction material to facilitate boom extension and retraction whether loaded or unloaded.

25 Claims, 13 Drawing Figures

TELESCOPIC CRANE BOOM HAVING CORRUGATED BOOM SECTIONS

BACKGROUND OF THE INVENTION

1. Field of Use

This invention relates generally to telescopic booms such as are used on mobile cranes or the like. In particular, it relates to the construction of such telescopic booms and boom sections therefor.

2. Description of the Prior Art

Current practices in the construction industry and building trades require mobile cranes having telescopic booms which can handle increasingly heavier loads and raise them to greater heights. Attempts to increase boom size, load-handling capability, and strength merely by enlarging the size of prior art designs have not been entirely successful. As the physical size of such telescopic booms and the boom sections used therein are increased, and as the lengths to which they can be extended are increased, the booms become extremely heavy and awkward to operate. Further, the excessive deflections due to higher forces hinder precise load handling and cause undesirable whiplash. Various approaches in boom design and construction have been employed to achieve greater size and strength without suffering undue weight penalties. For example, lattice-type booms are sometimes employed and attempts have been made to lighten the boom by piercing holes in the heavy gauge sheet steel of which some boom sections are fabricated. Also, designs employing optimum selection and arrangement of boom section components have been employed to achieve high strength versus weight ratios.

Typical boom sections comprise rectangular, trapezoidal or triangular cross sections. Very often, in booms wherein the top, bottom and side walls are made of steel plate, high strength structural steel about 3/16 of an inch thick is the minimum thickness necessary in boom walls to obtain acceptable performance in respect to buckling, tensile, and compressive stresses. Often, such boom walls are provided with reinforcement bars, channels, and a multiplicity of stiffeners. Such construction has disadvantages. The walls or channels are most generally joined by means of welding processes which use filler material. Thus, structural integrity is achieved by depositing of some welding rod material. This is time-consuming, costly in terms of labor and material, and also adds to the weight of the boom. Typically, the welding material per se amounts to from ½ to 1½% of the boom weight. Also, to accommodate sliding between the adjacent boom sections, bearing pads of various materials and configurations are used, such as rollers, bearings, Teflon slide or bearing pads. For practical design reasons, pads are limited in size. And, since the bearing loads are high and the load bearing surface is small, bearing pads are subject to high compressive stresses. Therefore, high wear occurs and thus adjustment means are required to maintain proper clearance between the boom sections.

The prior art contains numerous examples of prior art telescopic booms and the following U.S. patents show the state of the art: U.S. Pat. Nos. 4,004,695; 4,003,168; 3,931,698; 3,890,757; 3,719,403; 3,708,937; 3,690,742; 3,620,579; and 3,423,890. U.S. Pat. No. 3,931,698 discloses an improved crane boom structure for telescopic boom sections. The conventional, generally rectangular cross-sectional shape is modified to provide central guiding of the boom sections to locate the bearing forces transmitted between sections at or near the neutral axis where bending stresses are minimal for greater load carrying capacity for a given boom weight. The boom side walls are provided with channel-shaped projections, the top and bottom channel legs being located on either side of the neutral axis of the beam section, preferably symmetrical therewith. Bearing members are interposed between top and bottom channel legs of contiguous boom sections.

SUMMARY OF THE PRESENT INVENTION

In accordance with the present invention, there is provided a large light-weight telescopic crane boom which comprises a plurality of relatively movable boom sections, such as base, intermediate, outer, and fly sections, and each section comprises top and bottom walls and a pair of spaced apart side walls. In each pair of relatively movable adjacent boom sections wherein one (outer) section is telescopically receivable within another (inner) section, the inner surface of the side walls of the outer section and the outer surface of the side walls of the inner section comprise longitudinally extending corrugations or projections which interengage and whereby the inner section is slideably supported on the outer section. The corrugations or projections on each wall surface are arranged in two (upper and lower) sets, one above and the other below, the longitudinal neutral axis of the crane boom. When the inner section is telescoped within the outer section and the crane boom is not loaded, the upper set of corrugations of the inner section rest in slideable engagement on the upper set of corrugations of the outer section. When the inner section is extended relative to the outer section and the crane boom is loaded, the inner section flexes downward sufficiently so that the lower set of corrugations of the inner section also rest on the lower set of corrugations of the outer section to thereby distribute the load and increase the area of slideable engagement between the two boom sections. Mating surfaces of projections which are subject to sliding engagement are coated with anti-friction material to facilitate boom extension and retraction whether loaded or unloaded. Inserts are provided within some of the corrugations to provide additional support in high load-bearing areas of the bearing surfaces.

The boom sections in accordance with the present invention provide an improved light-weight boom assembly for cranes or the like by usage of ultra-high-strength, thin-walled steel, such as steel of Martensitic micro-structure. Such thin-walled material is commercially available in different grades, having tensile strength of up to 220,000 psi. This is more than twice the strength of typically used structural steel for boom sections, such as T-1 steel having tensile strength of some 100,000 psi. Such steel is available in flat or corrugated sheets or plates.

The corrugations used in the boom sections in accordance with the present invention provide satisfactory stiffness of the boom sections and such corrugations also enable a multiplicity of continuous bearing surfaces to be easily provided along the full length of each boom section. Thus, a boom in accordance with the invention is fabricated by constructing it from thin-walled, ultra-high-strength sheet steel. The boom has satisfactory strength and stiffness as a result of providing corrugations on all sides of a boom section. Laminations of thin-walled steel sheets are provided where necessary for strength and stiffness. Improvements in weight-to-load capacity are obtained by employing non-consumable welding processes. Boom cost is reduced by employing high-speed automatic non-consumable welding processes. In the boom assembly a multiplicity of load bearing surfaces are provided along the entire length of each boom section, whereby bearing pads and bearing pad adjustment means are eliminated. The multiplicity of continuous bearing surfaces are provided with a high strength lubricant coating, such as spray-applied nylon compounds. A minimum number of components of relatively basic shape, such as simple light-weight flat sheet metal plates and corrugated plates, are employed and bracing components of unduly complex shape are avoided thereby simplifying cutting, shaping, and welding. Flat and corrugated plates of minimum thickness are employed, taking into account other essential design considerations. Also, additional components such as internal braces and separate slide pad bearing surfaces are eliminated. Other objects and advantages of the invention will hereinafter appear.

DESCRIPTION OF A PREFERRED EMBODIMENT

Figure 2:
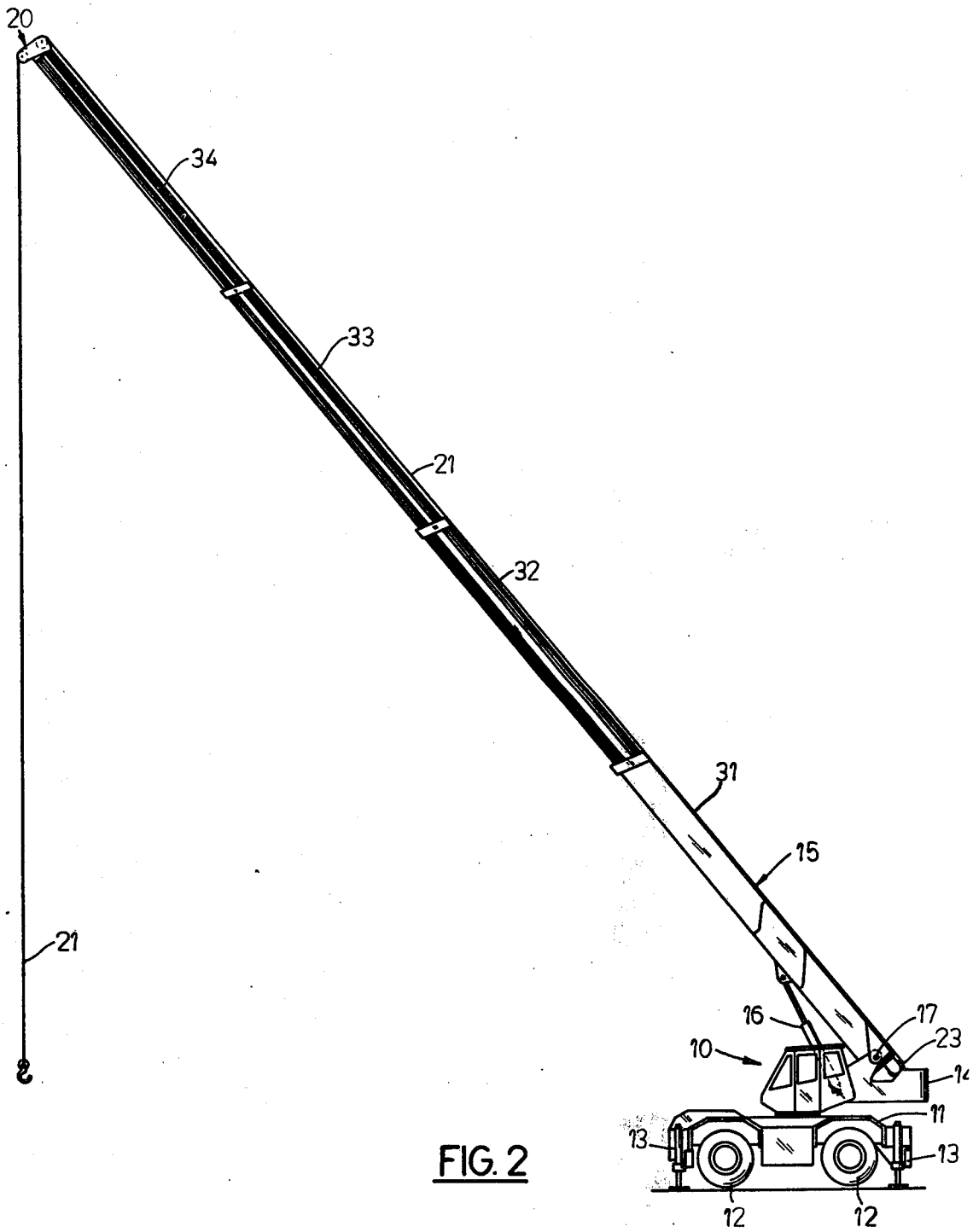
FIG. 2 is a view similar to FIG. 1 and shows the telescopic boom raised and fully extended.
Figure 1:
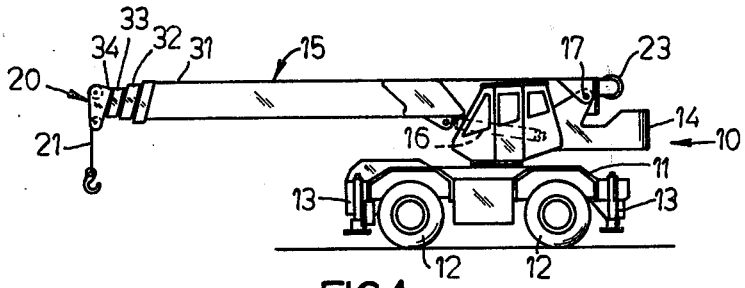
FIG. 1 is a side elevational view of a mobile crane having a telescopic boom employing boom sections in accordance with the present invention and showing the telescopic boom lowered and fully retracted.

Referring to FIGS. 1 and 2 of the drawings, the numeral 10 designates a mobile crane in accordance with the invention. Crane 10 comprises a carrier frame 11 having ground-engaging wheels 12, extendable and retractable outriggers 13 (shown fully retracted), and a rotatable crane upper 14 mounted thereon. Crane upper 14 comprises a telescopic boom 15 which is understood to be pivotable in a vertical plane by means of a boom hoist cylinder 16 about a trunnion 17. Boom 15 has a load hoist line sheave assembly 20 at its point end for supporting a load hoist line 21 which is connected to a hoist drum 23 on crane upper 14.

Figure 3:
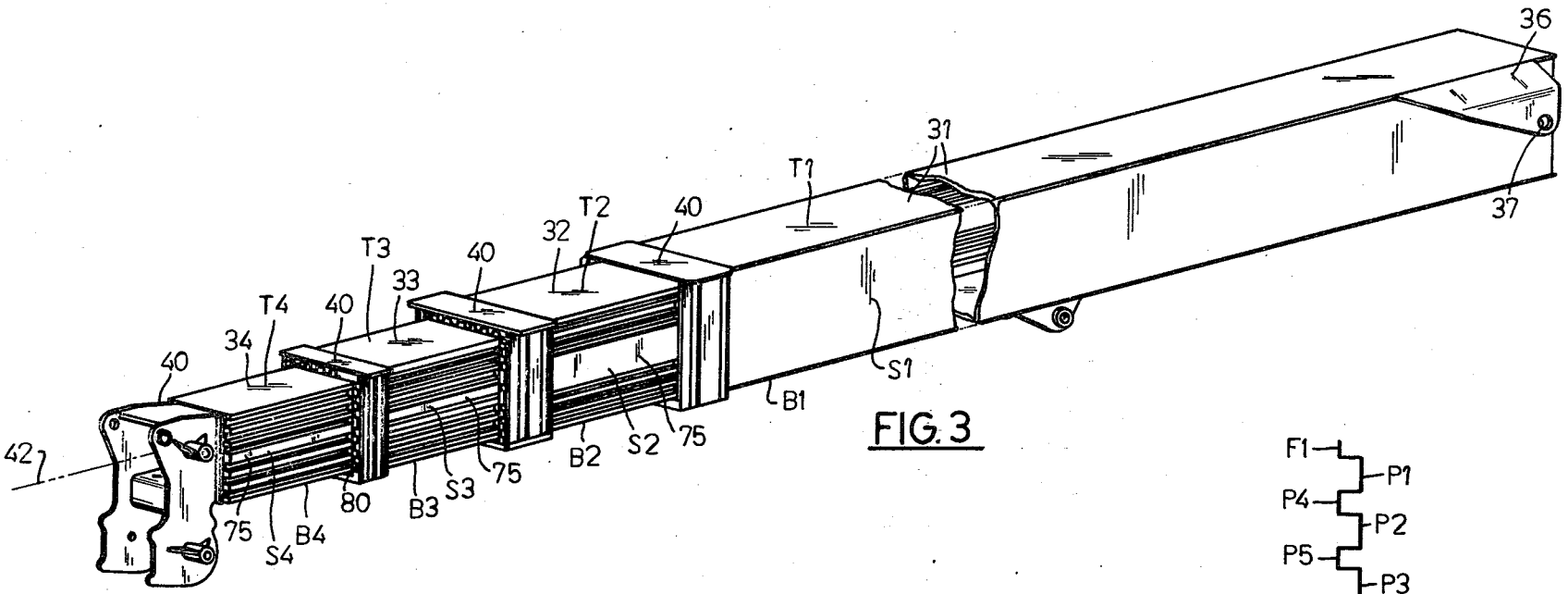
FIG. 3 is an enlarged perspective view of the telescopic boom of FIGS. 1 and 2 and showing it as removed from the crane, lowered and partially extended.
Figure 9:
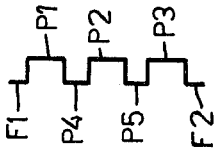
FIG. 9 is a cross section of the member shown in FIG. 6.
Figure 4:
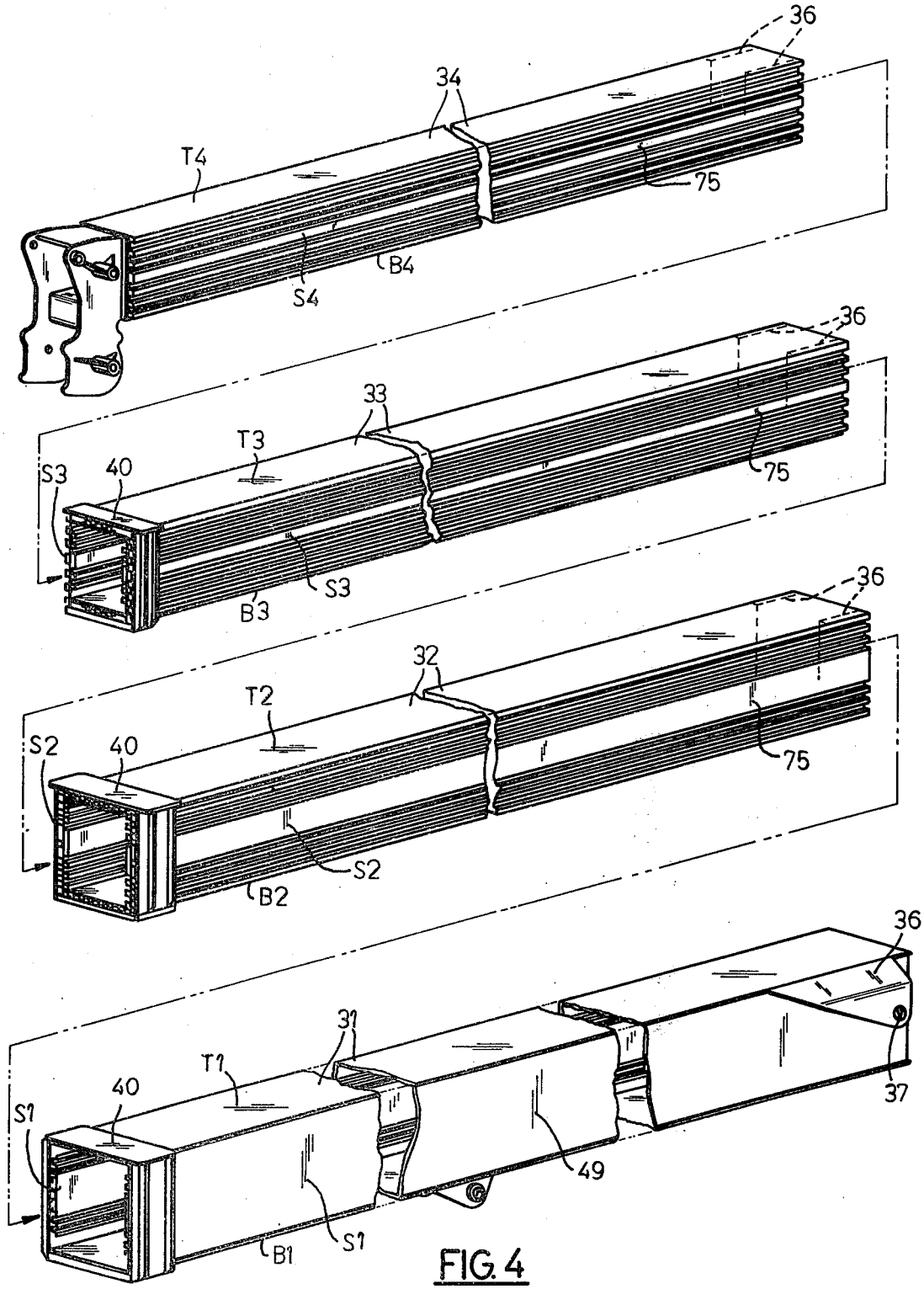
FIG. 4 is an exploded perspective view showing the boom sections of the telescopic boom of FIG. 3 fully separated from one another.

As FIGS. 1 through 5 show, boom 15, which is constructed in accordance with the invention, comprises a plurality of boom sections of hollow rectangular cross section, namely: a boom base section 31, an intermediate section 32, an outer section 33, and a fly section 34, each of progressively smaller transverse cross-section so that they are telescopable, one within another. FIG. 1 shows boom 15 lowered and fully retracted and FIG. 2 shows it raised and fully extended, whereas FIG. 3 shows the boom partially extended and FIG. 4 shows the boom sections 31, 32, 33, and 34 separated from one another so that they can be compared.

As FIG. 4 shows, each boom section 32, 33, and 34 is provided at its inner end with a support plate bracket or structure 36 on the inside surfaces of opposite sides thereof. The structure 36 on base boom section 31 is exteriorly located and each has a trunnion support 37 secured thereto for supporting trunnion 17 by means of which boom section 31 is pivotally mounted on crane upper 14, as FIGS. 1 and 2 show.

Each boom section 32, 33, and 34 is also provided at its outer end with a support structure 40. Support structure 40 on fly section 34 includes or is defined by portions of the hoist line sheave assembly 20 shown in FIGS. 1 and 2.

Figure 7:
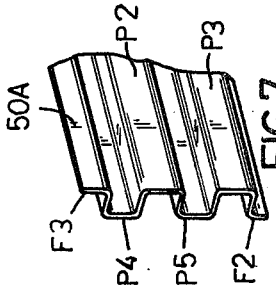
Figure 5:
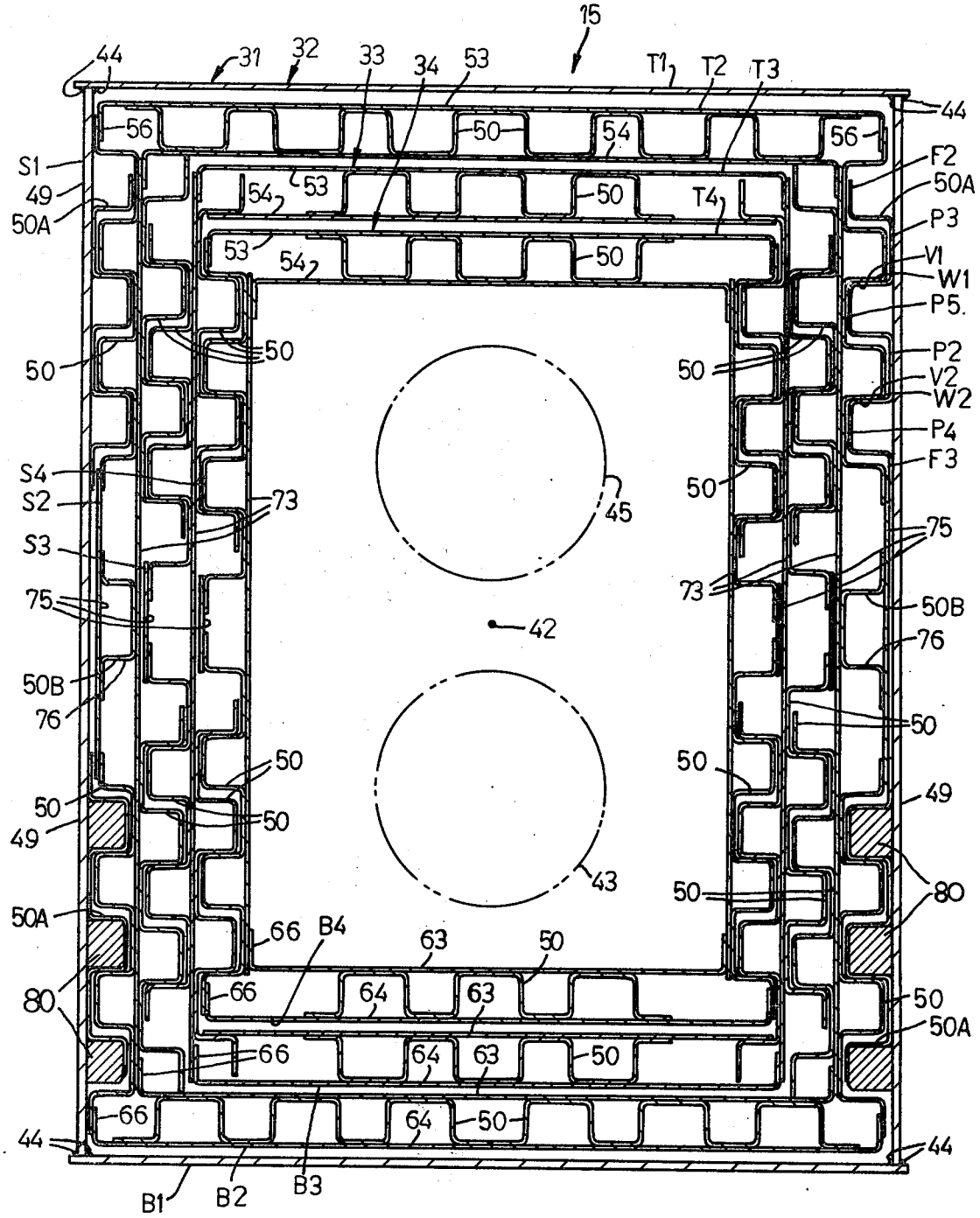
FIG. 5 is an enlarged cross-sectional view of the boom taken on line 5—5 of FIG. 3.

As FIGS. 3, 5, 10, and 11 show, telescopic crane boom 15 has a longitudinally extending horizontal neutral axis 42 which extends through base section 31 and the other movable sections 32, 33, 34 which are telescopically receivable within the base section. Hydraulic cylinders 43 and 45, shown in FIGS. 5 and 7, are located within boom 15 and are operable for telescopically extending and retracting the movable sections 32, 33, and 34 relative to each other and to the base section 31 in a conventional manner.

The boom sections 31, 32, 33, 34 comprise top walls T1, T2, T3, T4, respectively; bottom walls B1, B2, B3, B4, respectively; and pairs of spaced apart side walls S1, S2, S3, S4, respectively.

Figure 8:
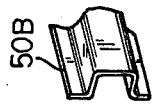
FIGS. 6, 7, and 8 are perspective views of an end of several types of sheets of corrugated members used in fabricating boom sections in accordance with the invention.
Figure 6:
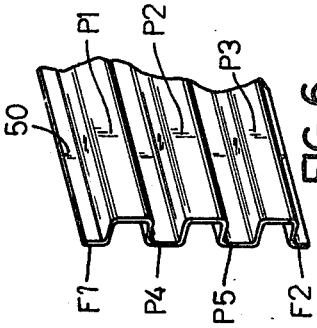

The top wall T1 and bottom wall B1 of base section 31 are fabricated of relatively thick solid steel plate. However, the side walls S1 of base section 31, and the top, bottom, and side walls of the other boom sections 32, 33, 34 are each fabricated of combinations of flat sheet metal members, hereinafter described, and longitudinally extending corrugated sheet metal members, such as the member 50, 50A, 50B shown in FIGS. 6 through 8, respectively, spot welded thereto, as hereinafter described. Each corrugated sheet metal member used in the construction of telescopic boom 15 is initially of the same size and configuration as member 50 of FIG. 6. However, as comparison of FIGS. 6 and 7 shows, the corrugated sheet metal members used in construction of base section 31 and designated 50A have one edge portion removed. As FIG. 6 shows, each corrugated sheet metal member 50 initially comprises three relatively wide projections P1, P2, P3 on one side and two relatively narrow projections P4, P5 and end flanges F1 and F2 on the opposite side. For purposes of identification and description hereinafter, that side of a corrugated member 50 on which the end flanges F1 and F2 lie in the same plane as the narrow projections P4, P5 will be referred to as the "flange side" and the opposite side will be referred to as the "reverse side."

Furthermore, as will hereinafter appear in regard to FIGS. 5 and 11, certain surfaces on the projections P1, P2, P3, P4, P5 function as slideably engagable upper and lower support and bearing surfaces and are designated V1, V2 (upper surfaces) and W1, W2 (lower surfaces), respectively.

Referring now to FIG. 5, the boom sections will be described in detail. In base section 31, each side wall S1 comprises a relatively thick solid steel plate 49, edge-welded as at 44 between the walls T1 and B1, and upper and lower corrugated sheet metal members 50A which have their reverse sides welded to the inside surface of plate 49 above and below, respectively, the horizontal neutral axis 42.

In boom sections 32, 33, 34 the top walls T2, T3, T4, respectively, each comprise a pair of vertically spaced apart flat plates 53 and 54 between which one or more corrugated members 50 are secured. More specifically, in top wall T2, two members 50 are arranged in edgewise association to each other and have their flange sides welded to upper plate 53 and their reverse sides welded to lower plate 54. In top wall T3, one member 50 is employed and has its reverse side welded to upper plate 53 and its flange side welded to lower plate 54. In top wall T4, one member 50 is employed and has its flange side welded to upper plate 53 and its reverse side welded to lower plate 54. Each upper plate 53 and lower plate 54 in the top walls T2, T3, T4 has downwardly bent lateral edges 56, except for lower plate 54 in top wall T3.

In boom sections 32, 33, 34, the bottom walls B2, B3, B4, respectively, each comprise a pair of vertically spaced apart flat plates 63 and 64 between which one or more corrugated members 50 are secured. More specifically, in bottom wall B2, two members 50 are arranged in edgewise association to each other and have their flange sides welded to lower plate 64 and their reverse sides welded to upper plate 63. In bottom wall B3, one member 50 is employed and has its flange side welded to upper plate 63 and its reverse side welded to lower plate 64. In bottom wall B4 one member 50 is employed and has its flange side welded to lower plate 64 and its reverse side welded to upper plate 63. Each upper plate 63 and lower plate 64 in the bottom walls B2, B3, B4 has upwardly bent lateral edges 66, except for upper plate 63 in bottom wall B3.

In boom sections 32, 33, 34, each side wall S2, S3, S4, respectively, comprises a vertical flat plate 73 to which corrugated members are welded, as hereinafter described. The upper edges of the vertical plates 73 in side walls S2, S3, S4 are welded, respectively, to the downwardly bent lateral edges 56 of the lower plate 54 in top wall T2, the upper plate 53 in top wall T3, and the lower plate 54 in top wall T4. The lower edges of the vertical plates 73 in side walls S2, S3, S4 are welded, respectively, to the upwardly bent lateral edges 66 of the upper plate 63 in bottom wall T2, the lower plate 64 in bottom wall T3, and the upper plate 63 in bottom wall T4.

In each boom section 32, 33, 34, each vertical plate 73 has welded to the outside thereof an upper corrugated member 50 and a lower corrugated member 50, located respectively above and below the horizontal neutral axis 42, and these upper and lower corrugated members 50 have their reverse side against vertical plate 73. The adjacent free ends of each pair of members 50 are joined by a flat plate 75 which is welded thereto for strength purposes. In boom section 32, a single U-shaped member 76 is welded between the outside of vertical plate 73 and the inside of flat plate 75 to further strengthen and support the latter.

In each boom section 32, 33, each vertical plate 73 has welded to the inside thereof an upper corrugated member 50 and a lower corrugated member 50, located respectively above and below the horizontal neutral axis 42, and these upper and lower corrugated members 50 have their reverse sides against vertical plate 73.

Figure 11:
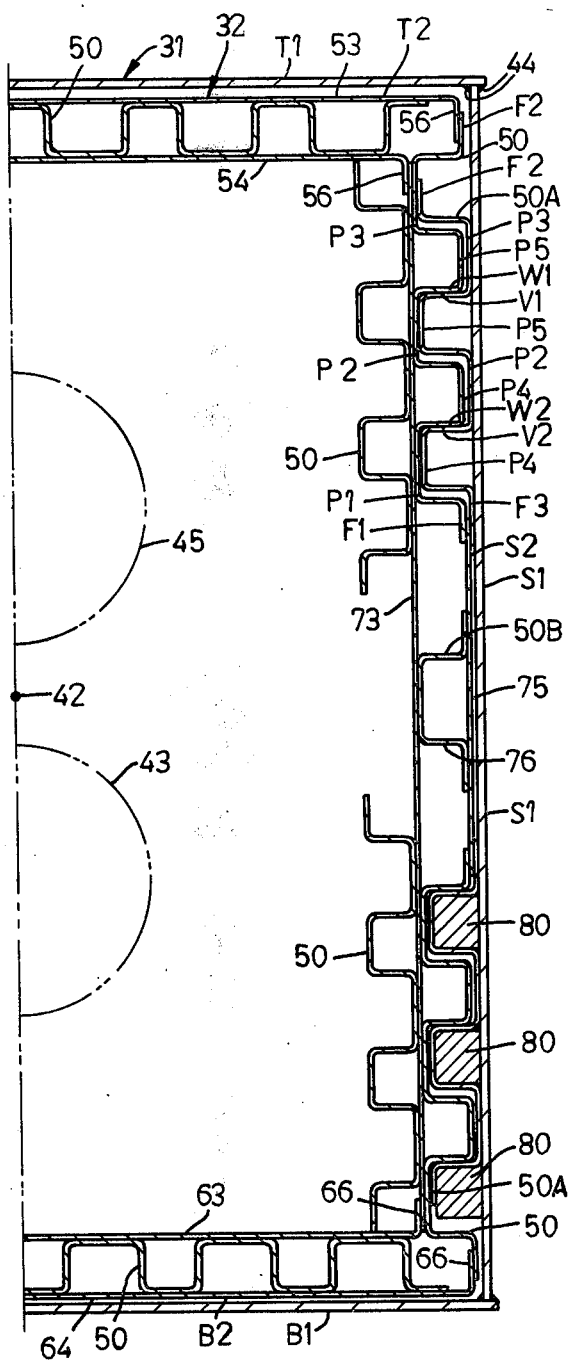
FIG. 11 is an enlarged cross-section view taken on line 11—11 of FIG. 10.

As FIG. 11 shows, in each pair of relatively movable adjacent boom sections wherein one (inner) section such as 32 is telescopically receivable within another (outer) section such as 31, the inner surface of the side walls S1 of the outer section 31 and the outer surface of the side walls S2 of the inner section 32 comprises longitudinally extending corrugations or projections defined by members 50A and 50, respectively, which interengage and whereby the inner section 32 is slideably supported on the outer section 31. As FIGS. 5 and 11 show, the corrugations or projections on each wall surface are arranged in two (upper and lower) sets, one above and the other below, the longitudinal neutral axis 42 of the crane boom.

As FIG. 5 shows, when the inner section 32 is telescoped within the outer section 31 and the crane boom is not loaded, the upper set of corrugations defined by the upper member 50 of the inner section 32 rest in slideable engagement on the upper set of corrugations defined by the upper member 50A of the outer section 31. More specifically, the lower surfaces W1 and W2 of the projections P5 and P4, respectively, of upper member 50 of inner boom 32 rest upon and slideably engage the upper surfaces V1 and V2 of the projections P3 and P2, respectively, of upper member 50A of outer boom 31.

Figure 10:
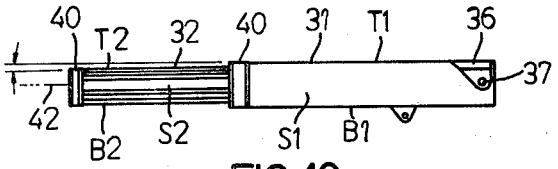
FIG. 10 is a side elevational view of the boom base section and the adjacent relatively movable boom section, showing the latter partially extended.

As FIGS. 10 and 11 show (compare to FIG. 5), when the inner section 32 is extended relative to the outer section 31 and the crane boom 15 is loaded, the inner section 31 flexes downward sufficiently so that the lower set of corrugations defined by the lower member 50 of the inner section 32 also rest on the lower set of corrugations defined by the lower members 50A of the outer section 31 to thereby distribute the load and increase the area of slideable engagement between the two boom sections 31 and 32. More specifically, the lower surfaces W1 and W2 of the projections P5 and P4, respectively, of upper member 50 of inner boom 32 rest upon and slideably engage the upper surfaces V1 and V2 of the projections P3 and P2, respectively, of upper member 50A of outer boom 31.

Mating surfaces of the projections P1 through P5 which are subject to sliding engagement such as surfaces V1, V2, W1, W2 are coated with anti-friction material to facilitate boom extension and retraction whether loaded or unloaded. Such anti-friction material may take the form of Teflon, nylon, Cycolac, or the like which is sprayed, painted, and baked on or otherwise applied.

It is to be understood that each pair of relatively movable adjacent boom sections, such as 32 and 33, 33 and 34, are arranged and operate in the same manner as described in connection with the boom sections 31 and 32.

In an actual embodiment of the invention, the sheet steel employed to fabricate the corrugated member 50, 50A, and 50B and the plates 53, 54, 63, 64, and 73 was on the order of 0.035 (0.89 mm) inches thick (1500MPa tensile strength). The steel employed is available from the Inland Steel Company and is identified as MartINsite Steel, a low carbon alloy-free, cold rolled steel which is described in that company's bulletin #12-75-

10M entitled "MartINsite Steel." Booms constructed in accordance with the invention of such material are light-weight, strong, and sufficiently resilient to allow for the hereinbefore-described flexing when extended relative to one another and loaded to enable the lower corrugations to become slideably engaged, along with the upper corrugations, thereby effecting load distribution.

As FIGS. 3, 5, and 11 show, inserts 80 are fabricated of vanadium steel and a rectangular cross section are preferably inserted in the spaces defined by those corrugations which define interengageable surfaces. The purpose of the inserts is to strengthen and prevent damage to the ends of the corrugations as the boom sections slide relative to one another and as the ends of the boom sections are subjected to flexing or bending loads. In an actual embodiment such steel inserts need not extend the entire length of the associated corrugation but may extend only for that length necessary to prevent the aforedescribed damage, i.e., in a boom section on the order of 30 feet long, each insert might be on the order of two or three feet long, for example.

In fabrication of the boom sections in accordance with the present invention, it is preferred that the sheet metal members be secured to one another where required by a process of support or resistance welding, thereby effecting substantial savings over costly conventional seam welding.

As is apparent from the foregoing, a crane boom constructed in accordance with the invention eliminates the need for separate slide pads or bearing means between adjacent relatively movable boom sections since the corrugations serve this purpose, as well as providing for light-weight strong wall structure for the top, bottom, and sides of the boom sections.

Figure 12:
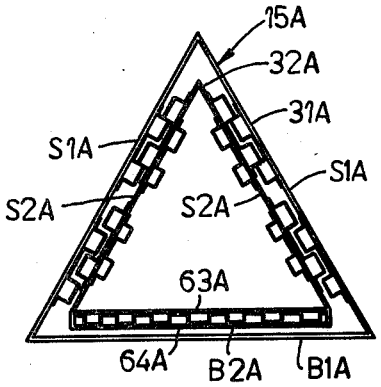
FIG. 12 is a cross-sectional view showing another embodiment of the invention.
Figure 13:
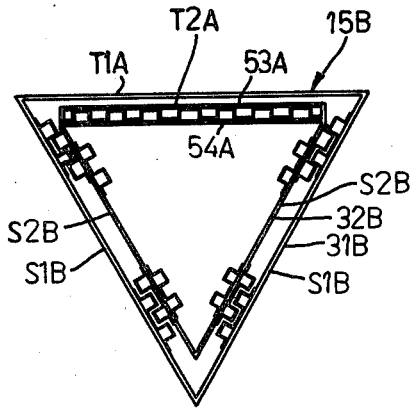
FIG. 13 is a cross-sectional view showing still another embodiment of the invention.

FIGS. 12 and 13 depict embodiments of the invention wherein the cross sections of booms 15A and 15B are triangular rather than rectangular. In the embodiment shown in FIG. 12, the apex of the triangle points upwardly and in FIG. 13, the apex points downwardly. In the embodiments shown in FIGS. 12 and 13, the outer boom sections 31A and 31B slideably support their associated inner boom sections 32A and 32B, respectively, and the sets of upper corrugations or projections are shown in engagement whereas the sets of lower corrugations or projections are not in engagement but are adapted to come into sliding engagement when the inner boom section is flexed downwardly, as under load. The embodiment shown in FIG. 12 includes bottom walls B1A and B2A an the latter is fabricated of spaced apart flat sheet metal members 63A and 64A between which one or more corrugated sheet metal members, such as 50, are secured as by welding. On the other hand, the embodiment shown in FIG. 13 employs top walls T1A and T2A and the latter is fabricated of spaced apart sheet metal members 53A and 54A between which one or more corrugated sheet metal members, such as 50, are secured as by welding. In FIG. 12 the spaced apart side walls S1A, S2A slope upwardly and inwardly. In FIG. 13, the spaced apart side walls S1B, S2B slope downwardly and inwardly toward each other.

I claim:

1. In a telescopic boom:

a first boom section;

a second boom section telescopically extendable and retractable within and relative to said first boom section;

each boom section comprising a pair of spaced apart side walls and each side wall having an outer surface and an inner surface;

a plurality of longitudinally extending outwardly projecting first projections on the outer surface of each side wall of said second boom section;

and a plurality of longitudinally extending inwardly projecting second projections on the inner surface of each side wall of said first boom section, the upper surface of each second projection slideably engaging the lower surface of a first projection to slideably support said second boom section on said first boom section.

2. A telescopic boom according to claim 1 wherein at least some of said projections are defined by corrugated sheet metal members.

3. A telescopic boom according to claim 1 including a coating of anti-friction material bonded to at least those surfaces of said projection which are subject to sliding engagement with each other to facilitate boom extension and retraction.

4. A telescopic boom according to claim 1 wherein said pair of spaced apart side walls of each boom section are parallel to each other.

5. A telescopic boom according to claim 1 wherein said pair of spaced apart side walls of each boom section slope toward each other.

6. In a telescopic boom:

a first boom section;

a second boom section telescopically extendable and retractable within and relative to said first boom section;

each boom section comprising a pair of spaced apart side walls and each side wall having an outer surface and an inner surface;

an upper set and a lower set of longitudinally extending first projections on the outer surface of each side wall of said second boom section;

and an upper set and a lower set of longitudinally extending second projections on the inner surface of each side wall of said first boom section, each upper set of second projections slideably engaging an upper set of first projections to slideably support said second boom section on said first boom section when said boom is not flexed, and each lower set of second projections slideably engaging a lower set of first projections to furnish additional slideable support for said second boom section when said boom is flexed.

7. A telescopic boom according to claim 6 wherein at least some of said projections are defined by corrugated sheet metal members.

8. A telescopic boom according to claim 6 including a coating of anti-friction material bonded to at least those surfaces of said projections which are subject to sliding engagement with each other to facilitate boom extension and retraction.

9. A telescopic boom according to claim 6 wherein said pair of spaced apart side walls of each boom section are parallel to each other.

10. A telescopic boom according to claim 6 wherein said pair of spaced apart side walls of each boom section slope toward each other.

11. In a telescopic boom:

a plurality of relatively movable boom sections, each section comprising a pair of spaced apart side walls, each pair of relatively movable adjacent boom sections comprising an outer section which is telescopically receivable within an inner section, the inner surface of the side walls of the outer section and the outer surface of the side walls of the inner section comprising longitudinally extending corrugated sheet metal members having corrugations which interengage and whereby the inner section is slideably supported on the outer section.

12. A telescopic crane boom according to claim 11 wherein the surfaces of corrugations which are subject to sliding engagement are coated with anti-friction material to facilitate boom extension and retraction.

13. A telescopic boom according to claim 11 wherein said pair of spaced apart side walls of each boom section are parallel to each other.

14. A telescopic boom according to claim 11 wherein said pair of spaced apart side walls of each boom section slope toward each other.

15. In a telescopic crane boom:

a plurality of relatively movable boom sections, each section comprising a pair of spaced apart side walls, each pair of relatively movable adjacent boom sections comprising an outer section which is telescopically receivable with an inner section, the inner surface of the side walls of the outer section and the outer surface of the side walls of the inner section comprising longitudinally extending corrugated sheet metal members having corrugations which interengage and whereby the inner section is slideably supported on the outer section, said corrugations on each wall surface being arranged in upper and lower sets, one above and the other below, the longitudinal neutral axis of the crane boom, whereby, when the inner section is telescoped within the outer section and the crane boom is not loaded, the upper set of corrugations of the inner section rest in slideable engagement on the upper set of corrugations of the outer section, and whereby, when the inner section is extended relative to the outer section and the crane boom is loaded, the inner section flexes downward sufficiently so that the lower set of corrugations of the inner section also rest on the lower set of corrugations of the outer section to thereby distribute the load and increase the area of slideable engagement between the two boom sections.

16. A telescopic crane boom according to claim 15 wherein the surfaces of corrugations which are subject to sliding engagement are coated with anti-friction material to facilitate boom extension and retraction.

17. A telescopic boom according to claim 15 wherein said pair of spaced apart side walls of each boom section are parallel to each other.

18. A telescopic boom according to claim 15 wherein said pair of spaced apart side walls of each boom section slope toward each other.

19. A telescopic boom according to claim 1 including at least one corrugated sheet metal member on at least one surface of each of said side walls for defining the projections.

20. A telescopic boom according to claim 19 wherein said pair of spaced apart side walls of each boom section are parallel to each other.

21. A telescopic boom according to claim 19 wherein said pair of spaced apart side walls of each boom section slope toward each other.

22. A telescopic boom according to claim 1 wherein each boom section further includes a top wall and a bottom wall, each of said top, bottom and side walls having an outer surface and an inner surface;

said top and bottom walls each comprising a pair of spaced apart sheet metal members defining the inner and outer surfaces thereof and having at least one corrugated sheet metal member secured therebetween;

each of said side walls comprising a sheet metal member secured to and between said top and bottom walls, and at least one corrugated sheet metal member secured to the sheet metal member of the side wall to define at least a portion of a surface of the side wall having projections to serve as a slideable support whereby said second boom section is supported on said first boom section.

23. A boom section according to claim 22 wherein a corrugated sheet metal member is secured to both sides of the sheet metal member in the side wall of at least one boom section to define at least a portion of the opposite surfaces of the side wall and to serve as slideable supports.

24. A boom section according to claim 22 including at least a pair of vertically spaced apart corrugated sheet metal members secured to the sheet metal member of the side wall to define a set of upper and a set of lower slideable supports.

25. A boom section according to claim 24 wherein said upper and lower sets are located above and below, respectively, the longitudinal neutral axis of the boom section.

* * * * *